US012690687B2

(12) United States Patent
Guogong

(10) Patent No.: US 12,690,687 B2
(45) Date of Patent: Jul. 28, 2026

(54) FOLDING CHAIR WITH STRUCTURAL ENHANCEMENTS FOR INCREASED LOAD BEARING

(71) Applicant: Zhuhai Shichang Metals Ltd., Zhuhai City (CN)

(72) Inventor: Tan Guogong, Zhuhai City (CN)

(73) Assignee: Zhuhai Shichang Metals Ltd., Zhuhai City (CN)

( * ) Notice: Subject to any disclaimer, the term of this patent is extended or adjusted under 35 U.S.C. 154(b) by 125 days.

(21) Appl. No.: 18/654,039

(22) Filed: May 3, 2024

(65) Prior Publication Data

US 2025/0213044 A1 Jul. 3, 2025

(30) Foreign Application Priority Data

Dec. 27, 2023 (CN) ..... 202323604773.4

(51) Int. Cl.
*A47C 4/24* (2006.01)
*A47C 4/06* (2006.01)

(52) U.S. Cl.
CPC . *A47C 4/24* (2013.01); *A47C 4/06* (2013.01)

(58) Field of Classification Search
CPC ..... A47C 4/24
See application file for complete search history.

(56) References Cited

U.S. PATENT DOCUMENTS 3,041,092 A * 6/1962 Eves ..... A47C 4/24 403/389
7,455,364 B1 * 11/2008 Lin ..... A47C 7/00 297/452.38
8,870,278 B2 * 10/2014 Tsai ..... 108/115
10,681,985 B2 * 6/2020 Lin

FOREIGN PATENT DOCUMENTS

GB 321989 A * 11/1929

* cited by examiner

*Primary Examiner* — Anthony D Barfield
(74) *Attorney, Agent, or Firm* — Luedeka Neely, P.C.; Mark P. Crockett

(57) ABSTRACT

A folding chair is designed to have a relatively high load-bearing capacity, while complying with safety standards and reducing production costs. The folding chair includes a front leg frame, a rear leg frame, four bowl-shaped washers, reinforcing steel sheets, and a seat plate. The front leg frame and the bowl-shaped washers are welded together. Each of the bowl-shaped washers is formed with two reinforcing ribs. The reinforcing steel sheets are arranged on the inside of the seat frame to strengthen the assembly. The front leg frame, the seat frame, and the reinforced steel sheets are rotationally attached in series using a first set of seat fasteners, and the rear leg frame, the seat frame, and the reinforced steel sheets are rotationally attached in series using a second set of seat fasteners.

7 Claims, 6 Drawing Sheets

FOLDING CHAIR WITH STRUCTURAL ENHANCEMENTS FOR INCREASED LOAD BEARING

FIELD OF THE INVENTION

This invention relates to the field of folding chairs. More particularly, this invention relates to structural enhancements to increase the load-bearing strength of a folding chair.

BACKGROUND OF THE INVENTION

Folding chairs are very common, and their folding function greatly facilitates their operation and use. The common structure of a folding chair comprises front and rear legs, a seat, and a backrest. Existing folding seat materials are generally classified into three materials: wood, plastic, and metal. Most folding chairs have mechanisms with four pivot points attached to the legs and the seat on opposing sides of the seat. An example of such a folding chair structure is described in U.S. Pat. No. 10,681,985, the entire contents of which are incorporated herein by reference.

Most existing folding chairs have load-bearing strength that is widely applicable to the general public. But for heavier users, there is a certain risk of collapse if the load-bearing strength is not sufficient to accommodate their weight. Some countries have industry standard load-bearing safety requirements for folding chairs that are difficult to meet. Achieving such high load-bearing safety standards requires thickening, strengthening, and hardening various components of the chairs, which increases manufacturing costs.

What is needed therefore is a folding chair that achieves a relatively high load-bearing strength to meet safety standards, while reducing production costs.

SUMMARY OF THE INVENTION

The above and other needs are met by a folding chair designed to have a relatively high load-bearing capacity, while complying with safety standards and reducing production costs. The folding chair includes a front leg frame, a rear leg frame, four bowl-shaped washers, reinforcing steel sheets, and a seat plate. The front leg frame and the bowl-shaped washers are welded together. Each of the bowl-shaped washers is formed with two reinforcing ribs. The reinforcing steel sheets are arranged on the inside of the seat frame to strengthen the assembly. The front leg frame, the seat frame, and the reinforced steel sheets are rotationally attached in series using a first set of seat fasteners. The rear leg frame, the seat frame, and the reinforced steel sheets are rotationally attached in series using a second set of seat fasteners.

In a preferred embodiment, the seat frame is provided with a seat cushion.

In a preferred embodiment, the top of the front leg frame is provided with a backrest plate. A backrest pad is provided on the backrest plate, and the backrest pad and the backrest plate are riveted together.

In a preferred embodiment, a pair of pivoting brackets are provided between the front leg frame and the rear leg frame.

In a preferred embodiment, an angled tube sleeve is provided at the top of the rear leg frame.

In a preferred embodiment, foot covers are provided on the feet of the front leg frame and the rear leg frame.

Beneficial effects of the folding chair include:

(1) for producers and manufacturers, the folding chair described herein increases the product's useful lifetime, improves product quality, saves materials, improves production efficiency, and reduces manufacturing costs; and (2) for consumers, the folding chair described herein meets the needs of all user groups, avoids the risk of product deformation or even collapse that endangers personal safety when a heavy user sits in the chair, improves the safety and convenience of the chair, and makes consumers feel safer and more comfortable.

BRIEF DESCRIPTION OF THE DRAWINGS

Other embodiments of the invention will become apparent by reference to the detailed description in conjunction with the figures, wherein elements are not to scale so as to show the details more clearly, wherein like reference numbers indicate like elements throughout the several views, and wherein.

Figure 1:
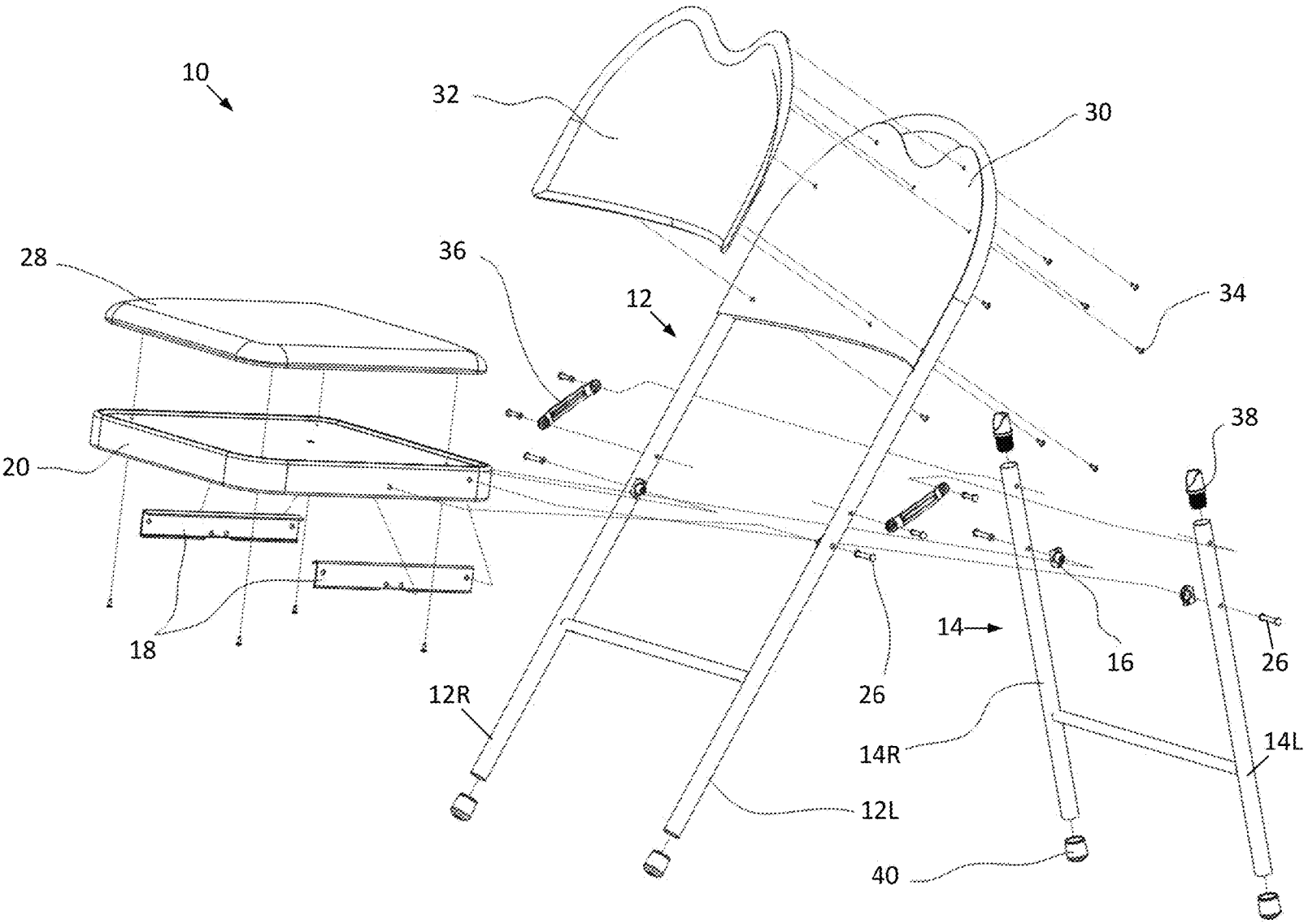
FIG. 1 is an exploded view of a folding chair according to an embodiment of the invention.
Figure 3:
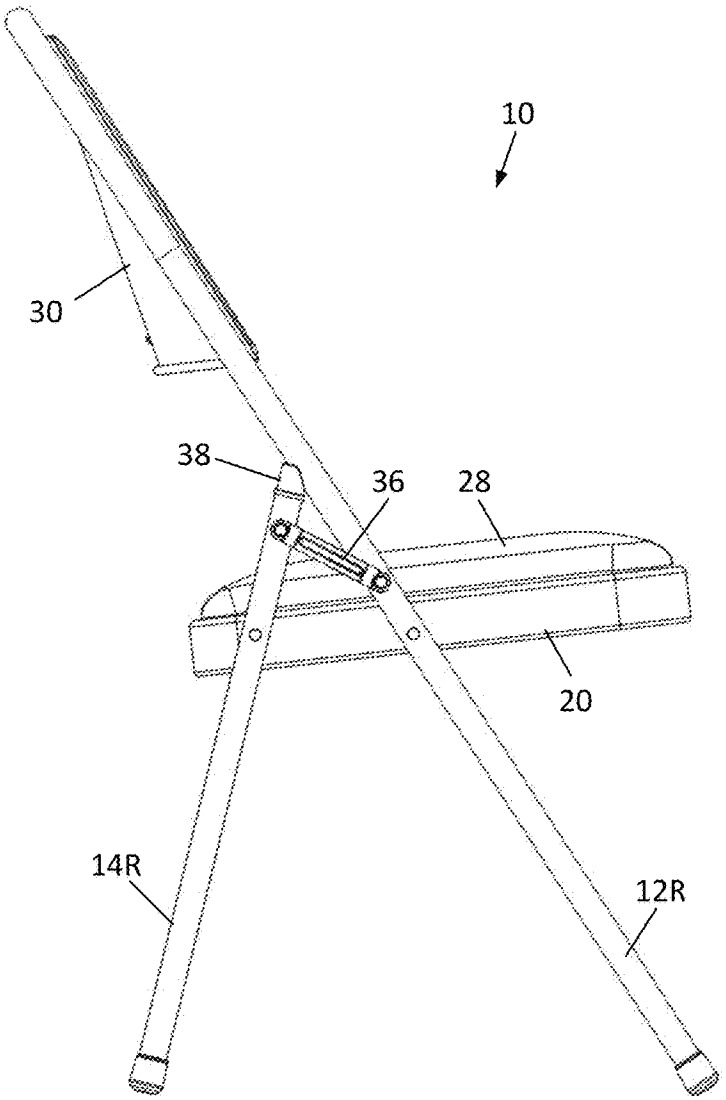
FIG. 3 is a right side view of a folding chair according to an embodiment of the invention.
Figure 2:
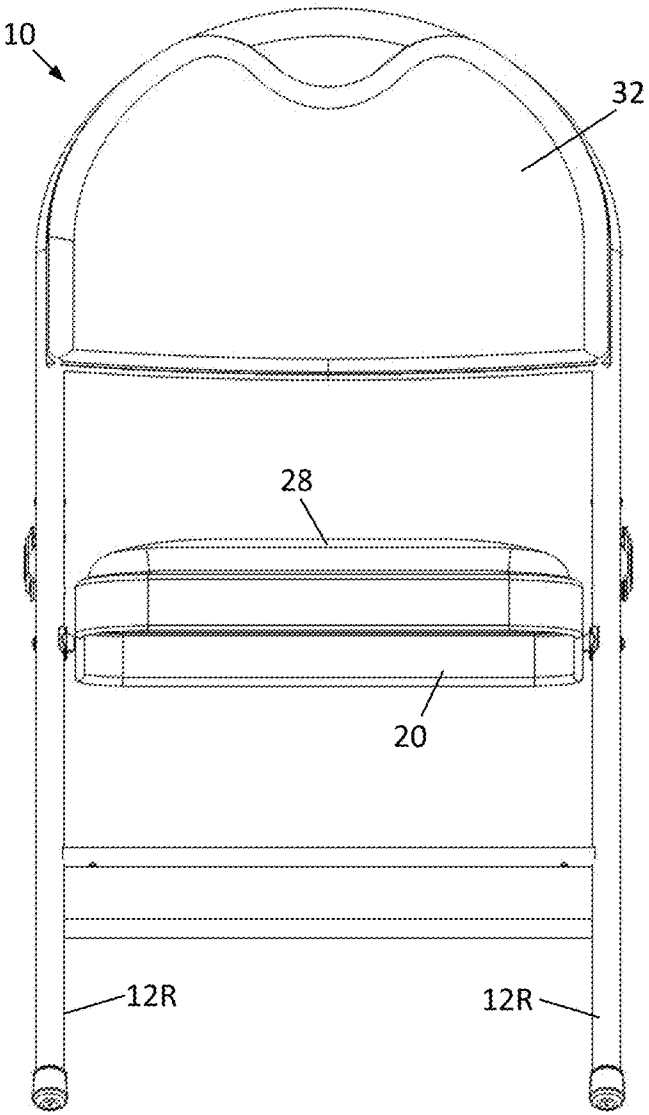
FIG. 2 is a front view of a folding chair according to an embodiment of the invention.
Figure 5:
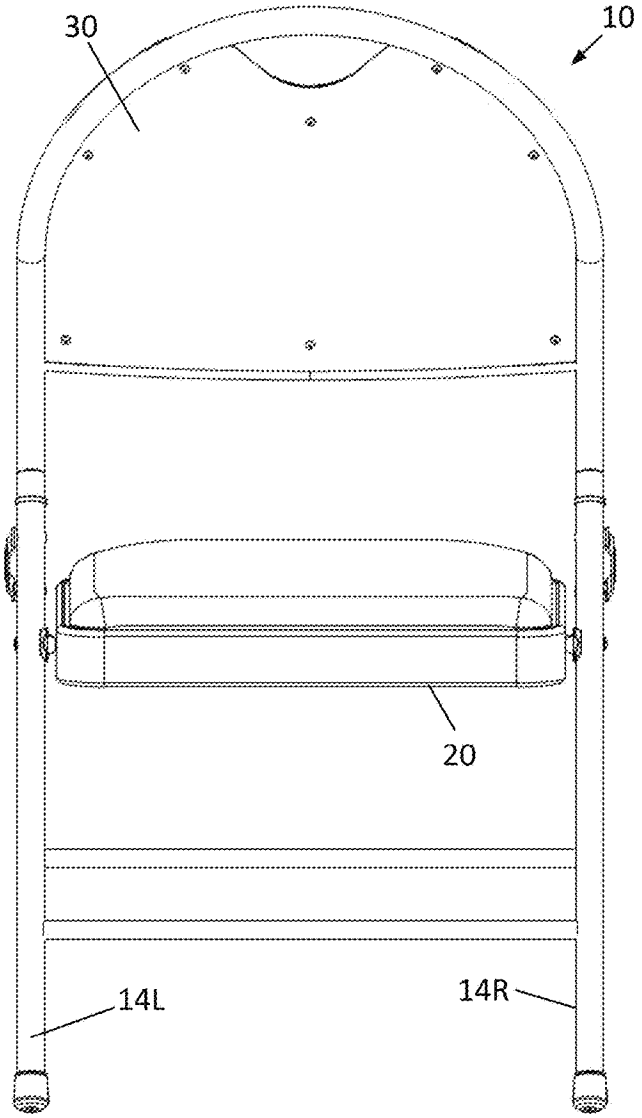
FIG. 5 is a rear view of a folding chair according to an embodiment of the invention.
Figure 4:
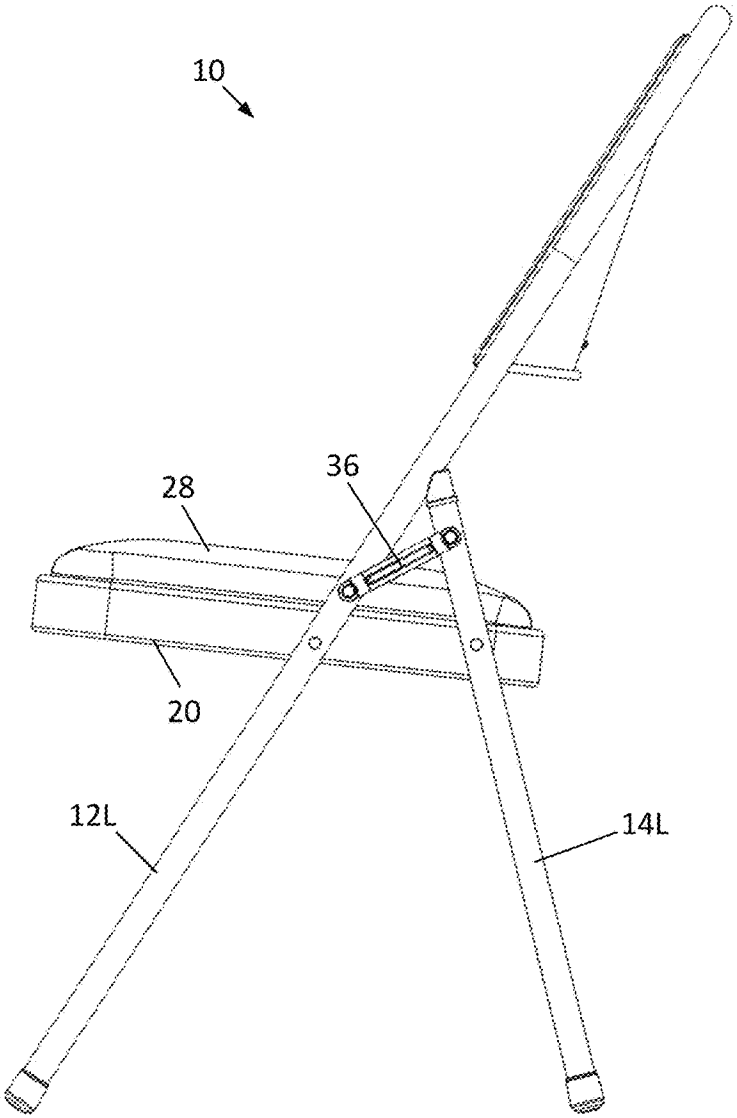
FIG. 4 is a left side view of a folding chair according to an embodiment of the invention.
Figure 7:
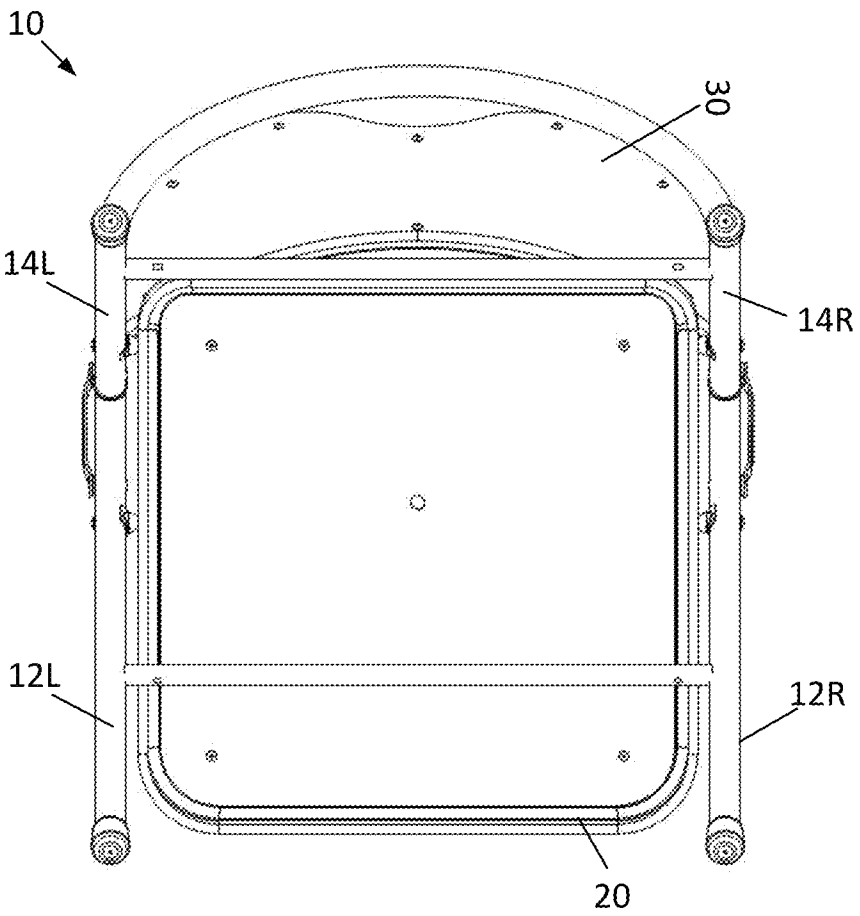
FIG. 7 is a bottom view of a folding chair according to an embodiment of the invention.
Figure 6:
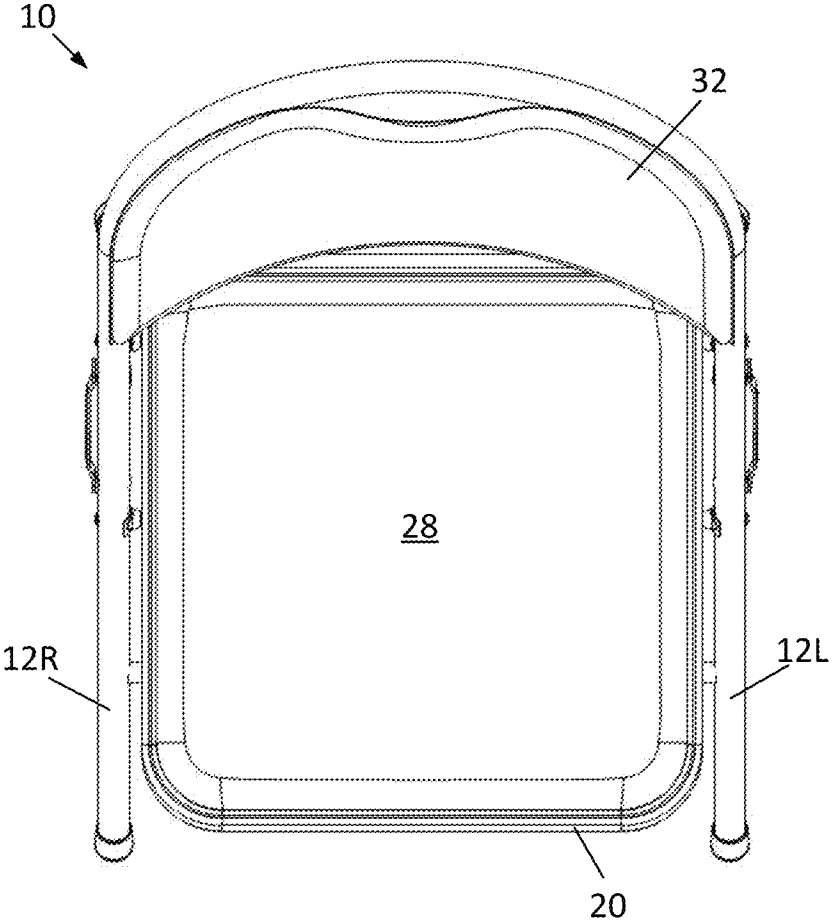
FIG. 6 is a top view of a folding chair according to an embodiment of the invention.
Figure 8:
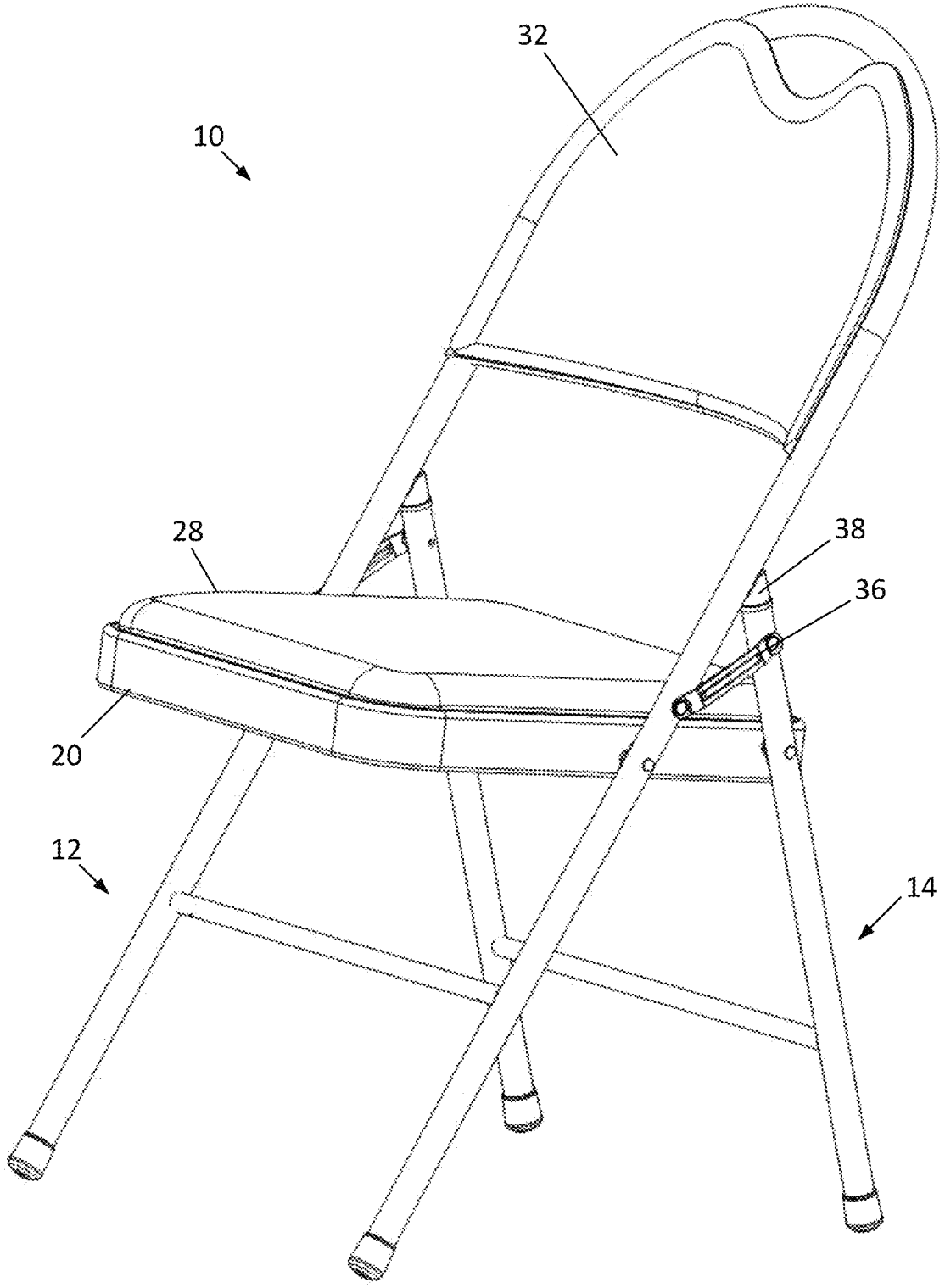
FIG. 8 is a top perspective view of a folding chair according to an embodiment of the invention.

EXPLANATION OF REFERENCE NUMBERS chair 10;
front leg frame 12;
right front leg 12R;
left front leg 12L;
rear leg frame 14;
right rear leg 14R;
left rear leg 14L;
bowl-shaped washers 16;
reinforcing steel sheets 18;
seat frame 20;
weld beads 22;
reinforcement ribs 24;
seat fasteners 26;
seat cushion 28;
backrest plate 30;
backrest cushion 32;
rivets 34;

pivoting brackets 36;
inclined tube sleeves 38; and
foot covers 40.

DETAILED DESCRIPTION

It should be noted that if the embodiments described herein involve directional indications (such as up, down, left, right, front, and back), the directional indication is only used to explain a specific posture (as shown in the figures) of the relative positional relationship, movement conditions, etc. between the various components described herein. If the specific posture changes, the directional indication will also change accordingly.

As shown in the drawings, embodiments described herein provide a folding chair 10 that includes a front leg frame 12 having a right front leg 12R and a left front leg 12L, and a rear leg frame 14 having a right rear leg 14R and a left rear leg 14L. The folding chair 10 also includes a seat frame 20, four bowl-shaped washers 16, two reinforcing sheets 18, and a seat cushion 28. In a preferred embodiment, the reinforcing sheets 18 are constructed from steel. It should be appreciated that the reinforcing sheets could be formed from other similarly rigid materials.

Figure 9A:
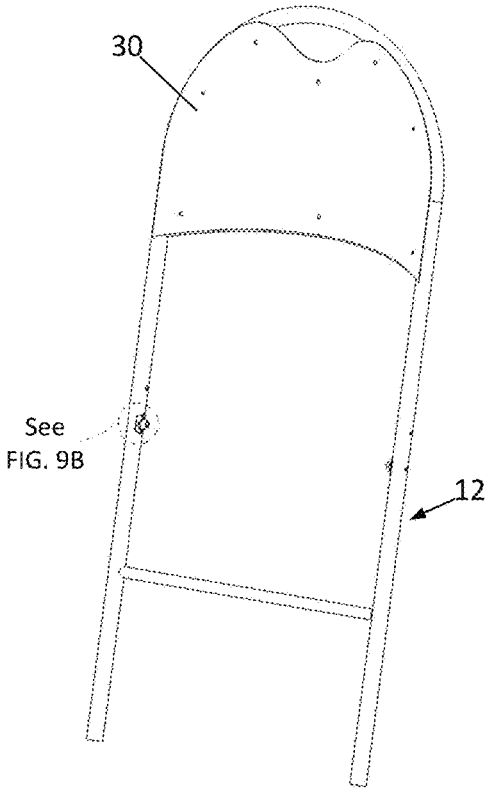
FIG. 9A depicts a front leg frame of a folding chair according to an embodiment of the invention.
Figure 9B:
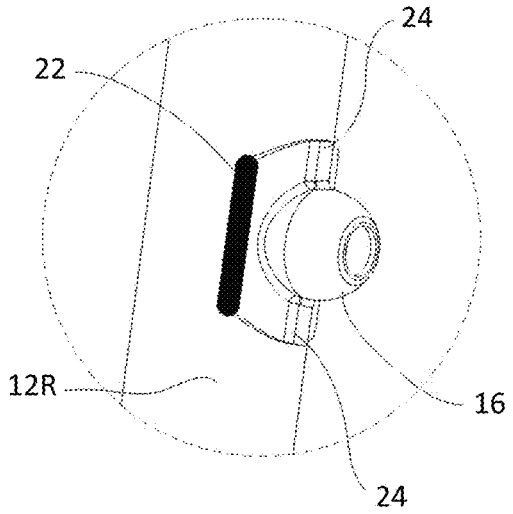
FIG. 9B is an enlarged view of a portion of the front leg frame depicted in FIG. 9A according to an embodiment of the invention.
Figure 10A:
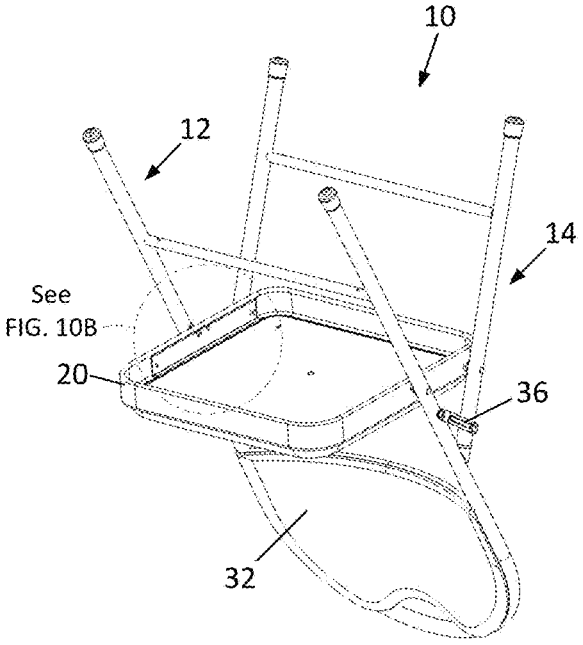
FIG. 10A is a bottom perspective view of a folding chair according to an embodiment of the invention.
Figure 10B:
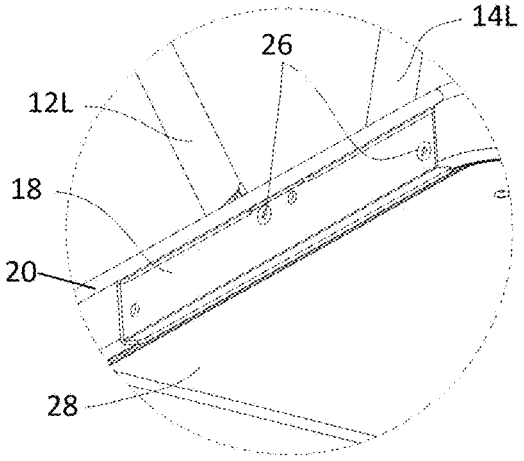
FIG. 10B is an enlarged view of a portion of the folding chair depicted in FIG. 11 according to an embodiment of the invention.

In preferred embodiments, two of the bowl-shaped washers 16 are welded to the front leg frame 12 and two are welded to the rear leg frame 14 using high-energy-density welding technology, such as laser welding or fusion welding, to form integral parts. As shown in FIG. 9B, each of the bowl-shaped washers 16 has two weld beads 22 and two reinforcing ribs 24.

During assembly, the reinforcing steel sheets 18 are placed on the inside of the seat frame 20. A first pair of the seat fasteners 26 are inserted through the front leg frame 12, the bowl-shaped washers 16, the seat frame 20, and the reinforcing steel sheets 18 in series. Similarly, a second pair of the seat fasteners 26 are inserted through the rear leg frame 14, the bowl-shaped washers 16, the seat frame 20, and the reinforcing steel sheets 18 in series. In preferred embodiments, the seat fasteners 26 may be semi-tubular rivets, pins, or bolts. The other parts are assembled as described herein to complete the assembly of the finished folding chair 10.

In the preferred embodiment, the reinforcing steel sheets 18, which are attached on each side of the seat frame 20, are connected to the front and rear leg frames 12 via the seat fasteners 26 passing through the bowl-shaped washers 16 that are welded to the front and rear leg frames 12 and 14. This construction greatly increases the load-bearing strength of the seat frame 20 and reduces the amount of deformation of the seat frame 20 when the folding chair 10 is subjected to heavy loads.

In the preferred embodiment, a seat cushion 28 is attached to the seat frame 20 by rivets 34. Also in the preferred embodiment, a backrest plate 30 is attached to the top of the front leg frame 12 by rivets 34, and the backrest pad 32 is attached to the backrest plate 30 by rivets 34.

Also in the preferred embodiment, pivoting brackets 36 are rotatably connected between the front leg frame 12 and the rear leg frame 14.

In the preferred embodiment, a pair of inclined tube sleeves 38 are installed on the top of the rear legs 14R-14L. Also in the preferred embodiment, foot covers 40 are installed on the bottoms of the front legs 12R-12L and the rear legs 14R-14L.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A folding chair comprising:
- a front leg frame comprising a right front leg and a left front leg;
- a rear leg frame comprising a right rear leg and a left rear leg;
- a plurality of bowl-shaped washers, each having reinforcing ribs formed thereon, the plurality of bowl-shaped washers including:
  - a first pair of the bowl-shaped washers, one of which is welded to the right front leg and another of which is welded to the left front leg;
  - a second pair of bowl-shaped washers, one of which is welded to the right rear leg and another of which is welded to the left rear leg;
- a seat frame rotatably attached to the front and rear leg frames;
- a plurality of reinforcing sheets attached to the seat frame, the plurality of reinforcing sheets including:
  - a first reinforcing sheet attached to a first inside surface of the seat frame; and
  - a second reinforcing sheet attached to a second inside surface of the seat frame;
- a first pair of seat fasteners that rotatably attach the front leg frame to the seat frame, wherein:
  - one of seat fasteners of the first pair pass through the right front leg of the front leg frame, the seat frame, and the first reinforcing sheet; and
  - another of seat fasteners of the first pair pass through left front leg of the front leg frame, the seat frame, and the second reinforcing sheet; and
- a second pair of seat fasteners that rotatably attach the rear leg frame to the seat frame, wherein:
  - one of seat fasteners of the second pair pass through the right rear leg of the rear leg frame, the seat frame, and the first reinforcing sheet; and
  - another of seat fasteners of the second pair pass through the left rear leg of the rear leg frame, the seat frame, and the second reinforcing sheet.

2. The folding chair according to claim 1 wherein the first and second reinforcing sheets are formed from steel.

3. The folding chair according to claim 1, further comprising a seat cushion attached to the seat frame.

4. The folding chair according to claim 1, further comprising:
- a backrest plate attached to a top portion of the front leg frame; and
- a backrest pad attached to the backrest plate.

5. The folding chair according to claim 1, further comprising:
- a first pivoting bracket rotatably between the right front leg of the front leg frame and the right rear leg of the rear leg frame; and a second pivoting bracket rotatably between the left front leg of the front leg frame and the left rear leg of the rear leg frame.

6. The folding chair according to claim 1 further comprising:

a first inclined tube sleeve attached to a top portion of the right rear leg of the rear leg frame; and a second inclined tube sleeve attached to a top portion of the left rear leg of the rear leg frame.

7. The folding chair according to claim 1 further comprising:

a first pair of foot covers attached to bottom portions of the right and left front legs of the front leg frame; and a second pair of foot covers attached to bottom portions of the right and left rear legs of the rear leg frame.

* * * * *